US009254014B2

(12) United States Patent
Weitzman

(10) Patent No.: US 9,254,014 B2
(45) Date of Patent: Feb. 9, 2016

(54) BOOT WITH STRETCHABLE OPENING

(71) Applicant: Stuart Weitzman, Greenwich, CT (US)

(72) Inventor: Stuart Weitzman, Greenwich, CT (US)

(73) Assignee: Stuart Weitzman IP, LLC, Ft. Lauderdale, FL (US)

( * ) Notice: Subject to any disclaimer, the term of this patent is extended or adjusted under 35 U.S.C. 154(b) by 0 days.

(21) Appl. No.: 14/139,176

(22) Filed: Dec. 23, 2013

(65) Prior Publication Data

US 2015/0173449 A1 Jun. 25, 2015

(51) Int. Cl.

| | |
|---|---|
| ***A43B 1/10*** | (2006.01) |
| ***A43B 7/06*** | (2006.01) |
| ***A41D 17/00*** | (2006.01) |
| ***A43C 11/00*** | (2006.01) |
| ***A43B 3/00*** | (2006.01) |
| ***A43B 3/04*** | (2006.01) |
| ***A43B 23/02*** | (2006.01) |
| ***A43B 23/04*** | (2006.01) |

(52) U.S. Cl.

CPC ..... *A43B 3/0036* (2013.01); *A43B 3/04* (2013.01); *A43B 23/0235* (2013.01); *A43B 23/0265* (2013.01); *A43B 23/047* (2013.01)

(58) Field of Classification Search

CPC ..... A43B 3/02; A43B 3/04; A43B 3/08; A43B 1/10; A43B 23/02

USPC ..... 36/102, 4, 51, 53, 6, 8, 1.5, 2 R, 83, 138, 36/45; 2/169, 168; 12/146 C

See application file for complete search history.

(56) References Cited

U.S. PATENT DOCUMENTS

| | | | | | |
|---|---|---|---|---|---|
| 131,199 | A | * | 9/1872 | Williams | 36/7.3 |
| 378,988 | A | * | 3/1888 | Warren | 36/51 |
| 546,065 | A | * | 9/1895 | Graven | 36/9 R |
| 1,064,479 | A | * | 6/1913 | Healy | 36/89 |
| 1,110,624 | A | | 9/1914 | Guiffre | |
| 1,250,940 | A | * | 12/1917 | Archambeau | 36/50.1 |
| 1,539,332 | A | * | 5/1925 | Smiley | 36/4 |
| 1,604,954 | A | * | 11/1926 | Artz | 36/7.1 R |
| 1,639,783 | A | * | 8/1927 | Norden et al. | 36/2 R |
| 1,737,795 | A | * | 12/1929 | Hodges | 36/2 R |
| 1,860,403 | A | * | 5/1932 | Burnham | 36/4 |
| 2,024,766 | A | * | 12/1935 | Ingwer | 36/7.3 |
| 2,068,500 | A | * | 1/1937 | Marinsky | 139/384 B |

(Continued)

FOREIGN PATENT DOCUMENTS

| | | |
|---|---|---|
| CN | 2313420 | 4/1999 |
| CN | 202800281 | 3/2013 |

(Continued)

OTHER PUBLICATIONS

The Shopping Channel, Arturo Chiang Sprinkle Heavy Elastic Boot, www.theshoppingchannel.com, 2013, pp. 1-4, USA.

(Continued)

*Primary Examiner* — Khoa Huynh
*Assistant Examiner* — Timothy K Trieu
(74) *Attorney, Agent, or Firm* — Gottlieb, Rackman & Reisman, P.C.

(57) ABSTRACT

In the preferred embodiment, a partial length slit is introduced in the inwardly facing wall of a boot in both the exterior and corresponding interior portions of the boot. Included in the midst of the slit, between the exterior and corresponding interior portions, is a piece of elastomeric fabric which preferably is stitched in.

17 Claims, 4 Drawing Sheets

(56) References Cited

U.S. PATENT DOCUMENTS

| | | | | | |
|---|---|---|---|---|---|
| 2,188,168 | A | | 1/1940 | Winkel | |
| 2,188,603 | A | * | 1/1940 | Hamalainen | 36/7.3 |
| 2,230,291 | A | * | 2/1941 | Evans | 36/7.3 |
| 2,311,996 | A | * | 2/1943 | Parker | 36/51 |
| 2,343,477 | A | * | 3/1944 | Ross | 36/10 |
| 2,507,726 | A | | 5/1950 | L'Hollier, et al. | |
| 2,666,996 | A | * | 1/1954 | Odland | 36/50.1 |
| 2,755,566 | A | * | 7/1956 | Harrison | 36/4 |
| 3,509,646 | A | * | 5/1970 | Vietas | 36/115 |
| 3,657,757 | A | * | 4/1972 | Vilder | 12/146 C |
| 3,763,579 | A | * | 10/1973 | Dexter | 36/50.1 |
| 3,810,319 | A | * | 5/1974 | Famolare, Jr. | 36/11.5 |
| 3,948,253 | A | * | 4/1976 | Burke | 602/29 |
| 4,064,641 | A | * | 12/1977 | Levine | 36/1.5 |
| 4,083,124 | A | * | 4/1978 | Michalak | 36/7.1 R |
| 4,333,192 | A | * | 6/1982 | Stockli et al. | 12/142 E |
| 4,489,509 | A | * | 12/1984 | Libit | 36/7.1 R |
| 4,586,271 | A | * | 5/1986 | Maleyko et al. | 36/1.5 |
| 5,381,610 | A | * | 1/1995 | Hanson | 36/100 |
| 5,784,806 | A | * | 7/1998 | Wendt | 36/2 R |
| 5,813,149 | A | * | 9/1998 | Baker et al. | 36/138 |
| 5,832,632 | A | * | 11/1998 | Bergeron | 36/58.5 |
| 6,026,598 | A | * | 2/2000 | Aschenbrenner | 36/137 |
| 6,148,544 | A | * | 11/2000 | Keen et al. | 36/1.5 |
| 6,651,257 | B2 | * | 11/2003 | Smith | 2/239 |
| 6,665,954 | B2 | * | 12/2003 | Chen | 36/3 R |
| 7,325,813 | B2 | * | 2/2008 | Bock | 280/11.19 |
| 7,441,351 | B2 | * | 10/2008 | Clark et al. | 36/138 |
| 7,980,010 | B2 | * | 7/2011 | Davis et al. | 36/138 |
| 8,510,972 | B2 | * | 8/2013 | Bizzo | 36/50.1 |
| 2003/0115775 | A1 | * | 6/2003 | Mazzarolo | 36/89 |
| 2003/0145484 | A1 | * | 8/2003 | Chen | 36/3 A |
| 2004/0010938 | A1 | * | 1/2004 | Li-Wang et al. | 36/9 R |
| 2004/0088890 | A1 | * | 5/2004 | Matis et al. | 36/138 |
| 2009/0025256 | A1 | * | 1/2009 | Bizzo | 36/50.1 |
| 2010/0031534 | A1 | * | 2/2010 | Davis et al. | 36/102 |
| 2011/0078924 | A1 | * | 4/2011 | Rackiewicz et al. | 36/102 |
| 2011/0225849 | A1 | * | 9/2011 | Zubyk | 36/136 |
| 2011/0239487 | A1 | * | 10/2011 | Renkes | 36/136 |
| 2011/0252666 | A1 | * | 10/2011 | Davis et al. | 36/87 |
| 2012/0186106 | A1 | * | 7/2012 | Recchi et al. | 36/102 |

FOREIGN PATENT DOCUMENTS

| | | | |
|---|---|---|---|
| DE | 20002936 | | 5/2000 |
| DE | 203 05 361 | U1 | 6/2003 |
| DE | 20305361 | | 6/2003 |
| DE | 202011000847 | | 6/2011 |
| DE | 102010053316 | | 9/2012 |
| EP | 0033566 | | 8/1981 |
| EP | 1419707 | | 5/2004 |
| EP | 1 749 454 | A1 | 2/2007 |
| ES | 1 077 759 | U | 10/2012 |
| GB | 366177 | | 2/1932 |

OTHER PUBLICATIONS

The Funky Monkey, Corso Como: Gage Havana Leather Boots, www.thefunky-monkey.com, 2012, pp. 1-10, USA.

European Search Report mailed by the European Patent Office on May 27, 2015 in the corresponding EP Application No. 14 161 811.6.

Canadian Intellectual Property Office, Examination Search Report, Mar. 6, 2015.

* cited by examiner

BOOT WITH STRETCHABLE OPENING

BACKGROUND OF THE INVENTION

1. Field of the Invention

The present invention relates to a boot or a bootie. More specifically, the present invention relates to the presence of a generally hidden internal elastic material placed behind an opening or behind a slit in the boot's exterior shell, and preferably placed between the exterior shell and an interior lining, where each of the shell and lining has a corresponding slit or opening at a position in the boot covering the inside ankle bone so as to facilitate foot entry or exit. The elastic material has characteristics of stretchability, so as to facilitate a person's ability to slip on or off the boot or bootie. The elastic material also has characteristics of revertability, so as, to facilitate the boot or bootie's return to a closed state and a snug fit. The location, of this material, internal to the boot and attached to the interior side of the external shell at the inside ankle bone area also results in the exterior shell appearing flush, thereby providing a sleek appearance.

2. Description of the Related Art

Boots are available in various shapes and sizes and for various purposes. In at least some situations, it is desirable for a boot to have attributes including a taut or snug fit as well as extended elevation, such as to near the wearer's knee. Examples of such situations include riding applications, such as but not limited to horseback riding and motorcycle riding, as well as aesthetic applications. Some of these taut-fitting boots are commonly known as "tube boots".

A wearer's comfort is an important consideration in footwear, both in wearing the footwear as well as putting the footwear on or taking it off. In general, the longer and/or narrower the boot, the more difficult it becomes to insert one's foot or to remove the foot from the boot. This is due to the boot's narrowing in the area near the ankle. Such narrowing is for reasons of stylishness as well as for fit. To accommodate foot entry and exit, some boots are widened near the ankle. A drawback to making the opening for the foot wider so as to allow ease of entry is that the foot does not fit snuggly when in the boot.

This problem has been addressed in the past in various ways such as by using zippers, laces, buckles, clasps, elastics, and other similar attaching devices used individually or collectively. In these solutions, the upper portion of the boot may be formed of multiple interconnected sections, and the sections can be closed together by connecting devices. For example, zippers have been introduced at various locations in a boot. Zippers often run vertically in the boot and can be located in the front, the back, a side, or some combination. Sometimes more than one zipper is used so as to provide numerous sections of relief. Elastics have been used on both sides of the footwear in order to provide a uniform stretch. While these solutions facilitates inserting or removing a foot, these connecting devices are difficult to hide while maintaining a flush appearance for the boot, and the use of such devices can leave open the opportunity for the connecting devices to catch on something, thereby resulting in possible injury to the wearer.

In some cases, stretch sectors have been built into footwear, including into boots and shoes. For example, gores have been strategically placed, such as at the vamp of a slip-on shoe. Two such examples are a single gore in the back of a shoe and multiple gores with a gore on each side. In these situations, an elasticized material is used which expands to allow the foot to enter a shoe. These solutions are not generally suitable to a boot or bootie, particular one with a high length which requires a foot to be angled in a particular way for entry as well as being hidden from view on the inside of the boot.

OBJECTS AND SUMMARY OF THE INVENTION

It would be beneficial to have a single area of a boot or bootie purposefully intended to facilitate a wearer's entry and exit of a foot and located on the inside facing area of the boot.

It would also be beneficial to have a facilitation element in a boot or bootie, such that the element remains flush with the exterior shell yet facilitates a foot's entry or exit. Such an embedded element should have no protrusion from a boot or bootie, provides a means for facilitating entry or exit of a foot from the boot or bootie, and leaves a sleek appearance.

Accordingly, there is a need for an improved boot construction that responds to at least one of the needs noted above.

It is another object of the present invention to provide a boot or bootie construction method that provides for sleek lines and accommodation for an entering or exiting foot, without the distractive of closure devices.

Another object of the present invention is to provide a boot construction and method that responds to at least one of the needs noted above.

Still another object of the present invention is to provide a construction method for a boot or bootie that allows the adaptive use of both nonelastic and elastic materials together while providing an outer appearance largely unnoticeable.

Yet another object is to provide a boot or bootie and method of its use, where the boot or bootie is flexibly adaptive to a wearer, particularly when the wearer is inserting or removing a foot.

Benefits to the present invention include a boot without additional attaching devices thereby preserving a sleek appearance, while concurrently accommodating a foot's entry or exit by extending at the area of the wearer's inside ankle bone. Benefits extend to the wearer as well and include improved comfort, primarily at the time of insertion or removal of a foot, as well as an improved fit.

Although in some cases the present application uses the term "boot", it is understood that the term is considered to encompass other forms of footwear as well, such as but not limited to booties and other footwear in which the wearer can benefit from further temporary expansion.

The present invention is directed to a boot which provides an enhanced comfort-fit for a wearer and a ready adaptation of the boot to a variety of different calf and foot shapes without stressing boot stitching or the external materials of the boot.

In the preferred solution, a boot is designed so as to facilitate inserting or removing a foot absent any additional mechanical devices, such as zippers, clasps, loops, buckles, or lacing. The boot includes an opening, such as a slit, which is positioned to allow for flexibility when a wearer inserts or removes a foot. Positioned within the opening, such as between the boot's outer shell and interior lining, is a piece of elastic or "stretchy" material, which is secured to the boot. This material is ordinarily hidden from view. However, when a foot is being inserted, particularly when the foot is extended downwardly, the opening together with the elastic material expand to provide flexibility for the foot's entry. The elastic material forces the opening to close to its original position when flexibility is no longer needed, such as after a foot is inserted or removed. Such a combination permits construction of a narrower boot in the lower calf through ankle area, which aids in providing a more secure fit when a foot is in place in the boot. The present invention does not include any additional mechanical closure devices to draw attention from the boot itself.

In the preferred embodiment, a partial length opening or slit is introduced in both the exterior material and the corresponding interior lining of a boot. Included in the midst of the slit, between the exterior material and the corresponding interior lining, is a piece of elastomeric fabric ("stretchy" or "elastic" material) which is preferably stitched in. The slit, generally linear in shape, is preferably 3-4 inches in length, although as discussed herein, the size and shape may vary. The slit is preferably located in the inside area side of the boot, about 3 inches up from the sole at its lowest point, approximately at the inner ankle bone, and somewhat perpendicular to the sole. That is, the slit is located approximately in line with a wearer's ankle bone. The slit is positioned and sized so as to facilitate entry and exit of a foot from the boot. In the preferred embodiment, as the wearer inserts a foot, the slit will temporarily expand and allow room for the foot to comfortably be inserted and can accommodate the foot, such as but not limited to protruding portions of the foot. One the foot is comfortably inserted in place (or removed) beyond the slit, the stretchy material's further property of reversion allow it to reform to the unstretched state, thereby making the exterior of the boot appear as uniform as it did before a foot had been inserted.

While described herein as a linear slit, the opening may take other forms as well, such as a rectangular shape with width, preferably 0.25 inches in width, or may be curved, such as somewhat elliptical in shape.

The elastic material is resident within the interior of the boot itself, preferably between the exterior shell and an interior lining and in the slit area. The internal elastic fabric has the properties of being stretchable and expandable when the foot is inserted. The amount of expansion is based on the need of the wearer. That is, the amount of expansion may vary from wearer to wearer. The slit expands as the wearer, when inserting or removing a foot, places pressure on the slit area by angling the foot for entry or exit. Such pressure may be consequential to the wearer's foot or protrusions or irregularities of the foot or ankle area.

The above, and other objects, features, and advantages of the present invention will become apparent from the following description, read together with the figures, in which like reference numerals designate the same elements.

DETAILED DESCRIPTION OF THE PRESENT INVENTION

The present invention is directed to a boot or bootie and, in the preferred embodiment, to an extended length tube boot, which includes a stretchy portion embedded in the boot at a slit within the boot itself. The combination of the slit and embedded stretchy portion serve to ease insertion and removal of a foot and to allow the boot to be shaped for a snug fit.

Figure 1:
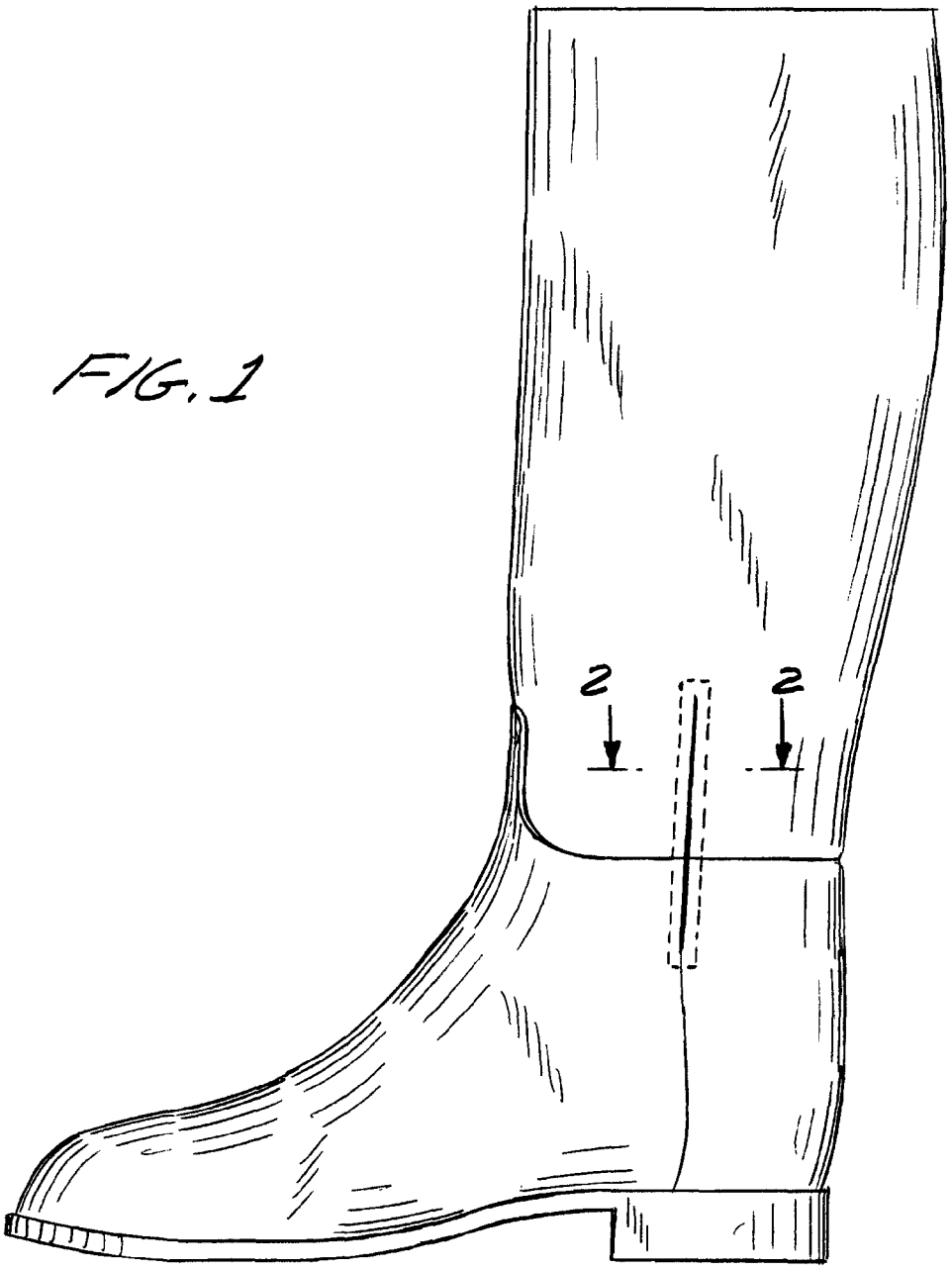
FIG. 1 shows a side perspective view of a right tube boot, particularly showing the inwardly facing side and a slit along the upper portion of the boot.

Although shown in the figures as a tube boot, the boot of the present invention may be of other types, such as but not limited to a riding boot, a cowboy boot, or an athletic footwear, such as a gymnastic shoe, ski boot or skate. Similarly, the boot need not be a high riding boot as shown in FIG. 1. The boot could be shorter and the length of the slit or slits can be sized accordingly.

According to an embodiment of the present invention there is provided a mid-shoe partial-length opening for a full length boot construction enabling an enhanced comfort-fit for a wearer, particularly when inserting or removing a foot.

FIG. 1 shows a side view of an image of a right boot including the preferred embodiment of the present invention. For purposes of terminology, the upper portion of the boot is considered to have an "outwardly facing side" and an "inwardly facing side" (also referred to as the "medial side"). FIG. 1 shows the inwardly facing side. Boot 100 includes outer shell 550. Outer shell 550 is preferably formed of leather, but other natural and synthetic materials may alternatively be used, such as materials commonly used for boot exteriors. As shown, boot 100 includes upper section 210, lower section 220 and together forming an outer she 550 on the exterior, and sole 230. In other embodiments, upper section 210 and lower section 220 may be combined.

As seen in FIG. 1, boot 100 includes external slit 300 with surrounding stitching 600. In this embodiment, external slit 300 appears on the inwardly facing side of boot 100. External slit 300 defines an opening or separation within the boot. External slit 300 is located at a point where a foot can benefit from relief during entry and exit from the boot. External slit 300 is entirely embedded in boot 100 and away from any edge of the boot. External slit 300 extends through outer shell 550 as shown in FIG. 1.

Figure 2:
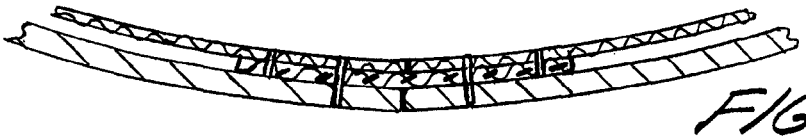
FIG. 2 shows a cross-sectional view of a portion of the inwardly facing side of the boot of FIG. 1, showing the location of the opening and stitching.

With reference to FIG. 2, the boot of the present invention includes interior lining 500 and elastic material 310. Elastic material 310 is located between interior lining 500 and outer shell 550 and, in the preferred embodiment, stitching 600 is used for attaching outer shell 550, elastic material 310, and interior lining 500. In some embodiments and as seen in FIG. 2, additional stitching 650 is used for attaching elastic material 310 with interior lining 500 so as to provide additional reinforcement. Internal silt 110, which is a slit in interior lining 500, positionally corresponds to the location of external slit 300.

In the preferred embodiment, external slit 300 and internal slit 110 may be formed by use of a cutting tool. In other embodiments, the slits 300 may be finished, such as by stitching. In other embodiments, slits 300 and 110 may be replaced by an opening with nominal width of 0.25 inches or less, or they may have some nominal curvature to them, such as forming a portion of an ellipse.

Ordinarily, and as seen in FIG. 1, external slit 300 in its resting position is closed or essentially closed, thereby providing minimal or no visibility to stretchy material 310 embedded in the boot. That is stretchy material 310 is not exposed or visible in the resting position.

Each slit can be in any number of orientations. In the preferred embodiment, each slit is aligned with the upper portion of the boot and slightly forward of the center of the upper portion by about 10 degrees with the top portion a bit forward, as shown in FIG. 1. In other embodiments, the slit may be oriented differently. For example, in other embodiments, each slit may be oriented at more or less than 10 degrees to vertical or may be somewhat curved. The slit may have some nominal width. In still other embodiments, each slit may be more than just a single slit. That is, a slit area might include multiple slits which are parallel to one another. The chosen quantity and location of slits can be based on how much flexibility is desired, and/or aesthetic considerations. In each case, one or more pieces of elastic material would reside between the outer shell and interior lining, and would collectively facilitate inserting or removing a foot. In all scenarios, the location of the slit is on the inward facing side of the boot at a position in which expansion would aid foot entry or exit. The shape and dimensions of the opening may vary.

Referring back to FIG. 1, stitching 600 totally surrounds the slit at an approximate distance of 0.25 inches from the slit on all sides, and extended all the way through the boot and through the interior lining. As shown, stitching 600 is overall rectangular, but can take other shapes as well. That is, stitching 600 is used to both provide an aesthetically pleasing finish and to assure adherence of stretchy material 310 within the boot. Alternatives or supplements to stitching may be used, such as use of adhesive materials, such as but not limited to glue, which could be internal to the footwear or on the interior face of the outer shell.

Figure 3:
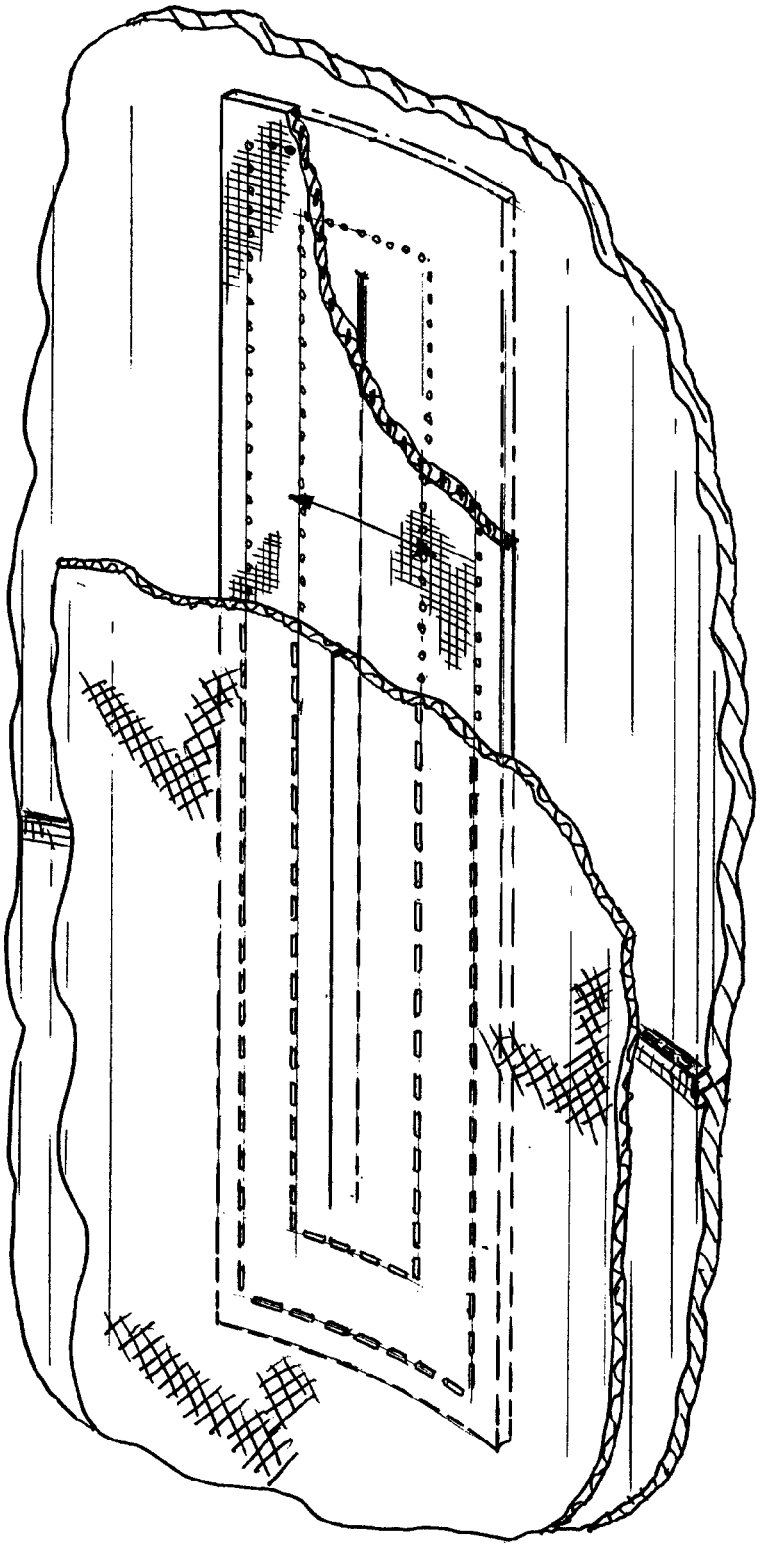
FIG. 3 shows an exploded view of the opening and elastic material of the present invention as seen from the inside of the boot.

FIG. 3 shows an exploded view facing outwardly from the interior of the boot of the present invention. Three layers appear in FIG. 3—interior lining 500 including interior slit 110, then elastic material 310, then outer shell 550 including external slit 300. In the preferred embodiment of the present invention, as seen in FIG. 3, interior slit 110 aligns with external slit 300. The general location of stitching 600 and internal stitching 650 is evident from the figure as well.

Nominally, stretchy material 310 is about 3.5 inches by 1 inch, although the dimensions need only be long and wide enough to be secured by stitching 600 or other adhesive devices and could be longer in either or both dimensions. Further, stretchy material 310 need not be rectangular and may take other shapes, such as to conform to other stitchery in the footwear.

In the preferred embodiment, the stretchy material used includes a physical property whereby, once the physical stretching is released, the material reverts back to its original shape and does not retain the stretched shape. Consequently, once the foot is inserted or removed, the slit's shape naturally returns to its resting position because the stretchy material reverts to its resting position and the boot adjusts accordingly. The size and location of each slit, together with the material used, allow for flexibility in the boot, which is particularly useful for when a person is inserting or removing a foot from the boot or inserting another object into the boot, such as an additional insole.

The elastic material can be formed of any of a number of materials which stretch from 50-100% of the original width. One significant feature of the stretchy material is its revertibility. That is, the material should return to its resting position after it is no longer stretched. In the preferred embodiment, the material used is any of several well known such materials, such as available from Avelino of Spain or Flextex of Italy. Preferably, the stretchy material primarily stretches along one direction, such as with its primary grain. In the preferred embodiment, the stretching direction should be aligned with the slit.

Figure 4:
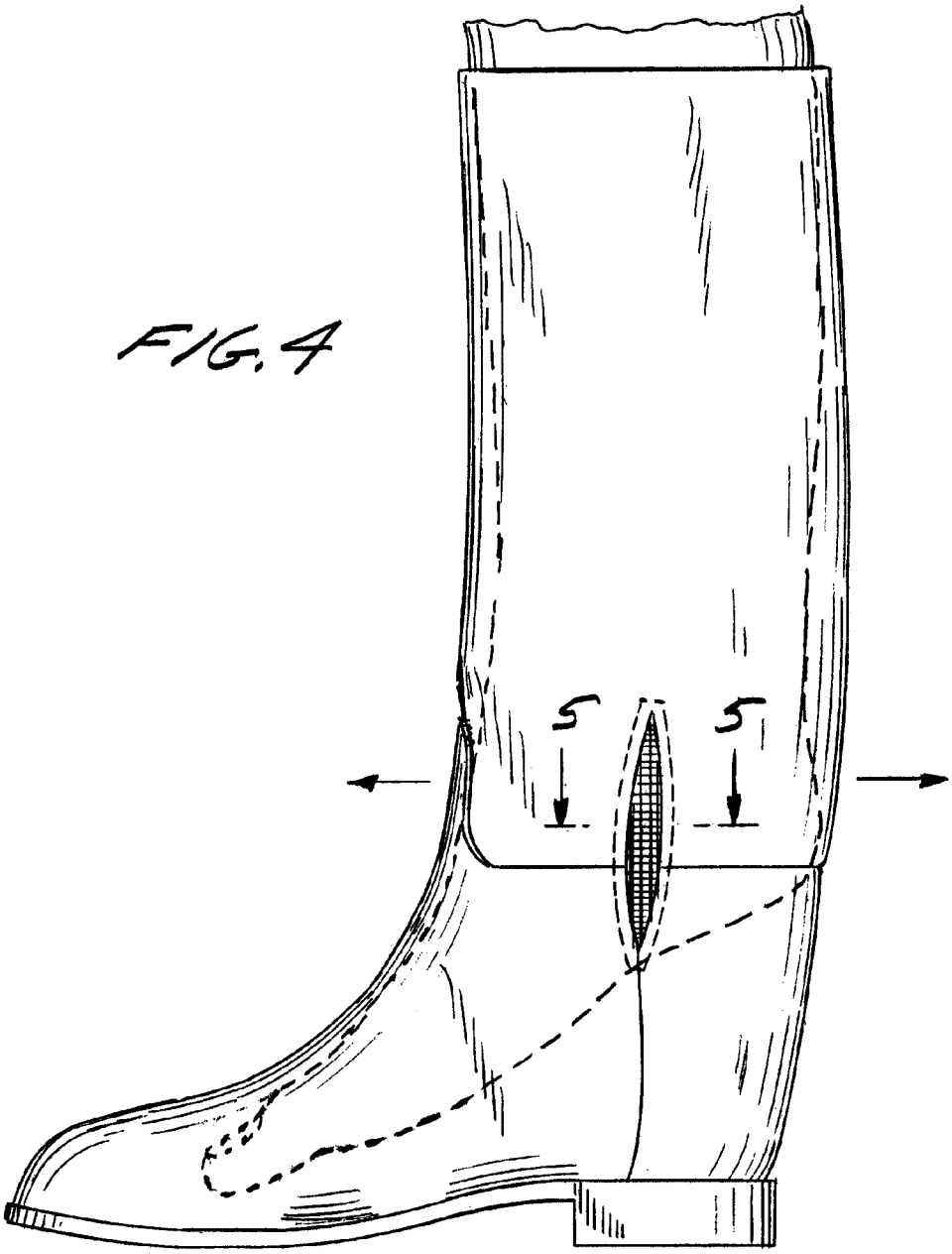
FIG. 4 shows a cross-sectional view of a portion of the inwardly facing side of the boot of FIG. 1 with a foot being inserted and an opening being exercised.
Figure 5:
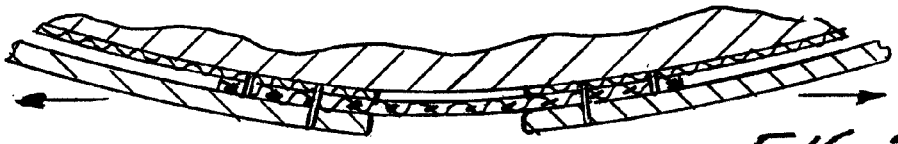
FIG. 5 shows a side perspective view of the boot of FIG. 1, showing the location of the opening and stitching, including with a foot being inserted and an opening being exercised.
Figure 6:
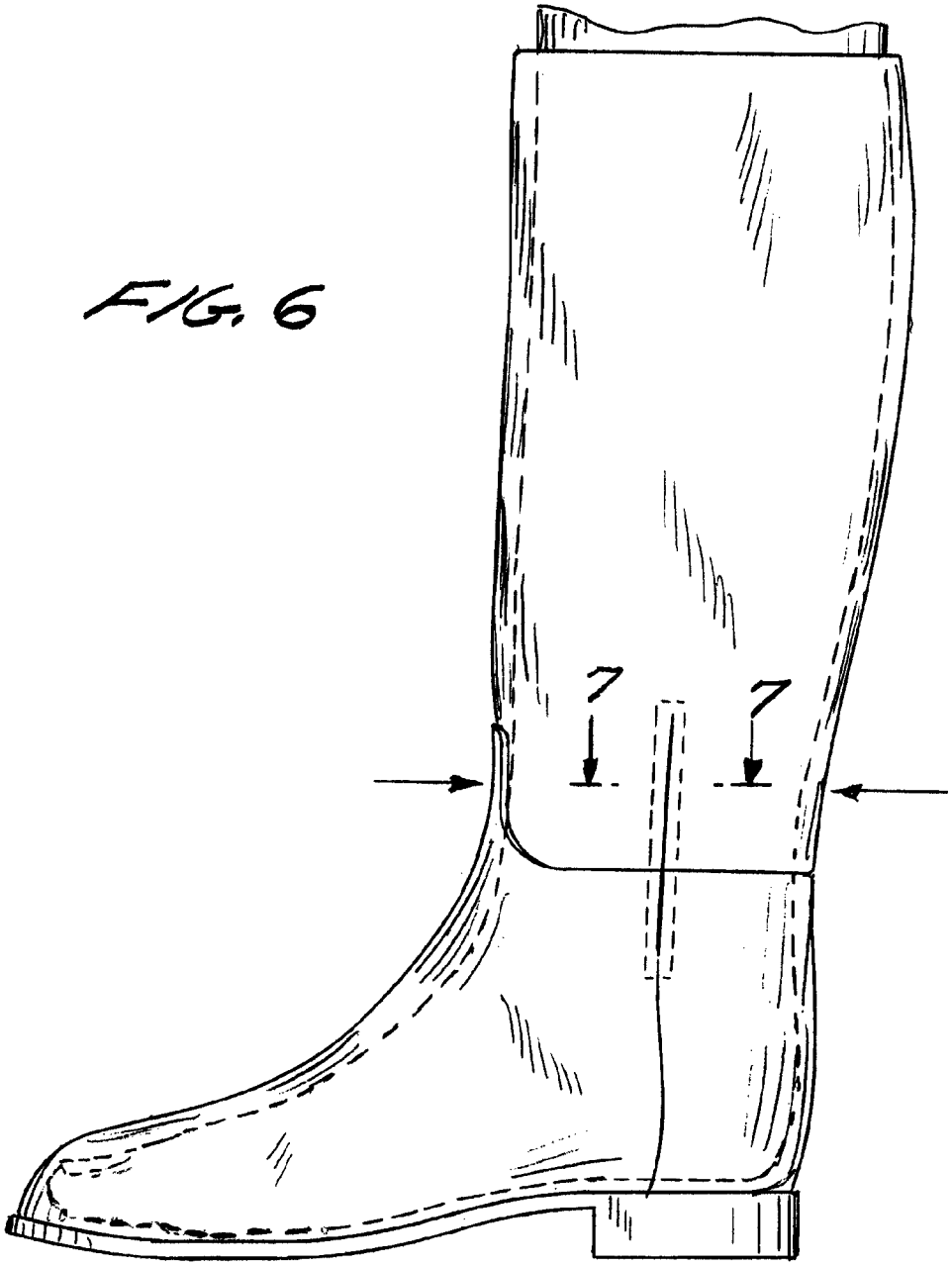
FIG. 6 shows a cross-sectional view of a portion of the inwardly facing side of the boot of FIG. 1 with a foot inserted.
Figure 7:
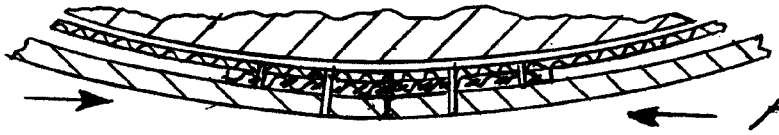
FIG. 7 shows a side perspective view of the boot of FIG. 1, showing the location of the opening and stitching, including with a foot inserted.

External slit 300 and internal slit 110 can be dimensionally changed when a foot is being inserted or removed from the boot. FIG. 4 shows external slit 300 in a non-resting or an expanded position, such as would be the case while a wearer is inserting a foot (also shown). As shown, slit 300 is expanded, as is the now externally visible elastic material 310. FIG. 5 shows a cross sectional view of the boot with a foot entering where the slits have expanded. As can be seen in FIGS. 4 and 5, when a foot is being inserted or removed, the slits expand somewhat to become wider openings and stretchy material 310 expands as needed. This dimensional change is purposeful in that the slits will expand when a wearer is inserting or removing a foot. As can be seen in FIGS. 6 and 7, when a foot is in the boot, the stretchy material returns to its resting state and the slits close.

While there has been shown and described what are considered to be preferred embodiments of the invention. It will, of course, be understood that various modifications and changes in form or detail could readily be made without departing from the spirit of the invention. It is, therefore, intended that the invention be not limited to the exact form and detail herein shown and described nor to anything less than the whole of the invention herein disclosed as hereinafter claimed.

The invention claimed is:

1. A boot comprising: an upper section including an outer shell and an inner lining and absent any mechanical closures, one partial length opening section which is located on an inwardly facing portion of said upper section, at a position to expand for an entering or exiting foot, and including a first slit defined as having parallel borders formed within said outer shell and a second slit formed within said inner lining and aligned with said first slit, a material with elastic properties embedded in said opening section between said first slit and second slid, and said material is entirely sandwiched between said outer shell and said inner lining, and a sole;

wherein said upper section is further defined by an upper above said sole and with a tapered extended cylindrical portion extending upwardly from said sole and adapted to cover at least a portion of the calf area with a generally circular upper edge defining a top opening of said boot at the top of said extended cylindrical portion;

wherein said top opening configured to allow for a wearer to insert a foot; said inwardly facing portion is a medial side; said first and said second slits are each located and extended along said medial side and do not directly intersecting said generally circular upper edge of said top opening of said boot; and said opening section is fully and completely located within said upper section, is generally in a closed position with said material in an unstretched configuration, said closed position defined as having said parallel borders directly touching one another which causes said unstretched material to be entirely hidden behind said first slit and said parallel borders when viewing directly from said medial side, said opening section being expandable so as to accommodate said foot entering or exiting said boot, and being automatically self-revertible to said closed position following said foot's entry or exit.

2. The boot of claim 1, wherein said opening section is in an area of the boot for covering an inside ankle bone of said wearer.

3. The boot of claim 1, wherein at least one of said slits in said opening section is linear.

4. The boot of claim 1, wherein at least one of said slits is surrounded by circumferential stitching.

5. The boot of claim 1, wherein said first and second slits are parallel to one another.

6. The boot of claim 1, wherein at least one of said slits includes a curve.

7. The boot of claim 1, wherein said first slit and said second slit are aligned with one another.

8. The boot of claim wherein each of said slits is 3-4 inches in length.

9. A method of formulating a boot comprising the steps of:

forming a sole;

forming a tapered leg portion with an outer she and an interior lining further defined by an upper above said sole and with an extended cylindrical portion extending upwardly from said sole to at least a portion of the calf area with a generally circular upper edge defining a top opening of said boot at the top of said extended cylindrical portion, said leg portion attached to said sole and said upper absent any mechanical closures;

forming a first opening within said outer shell, said first opening formed within an inwardly facing side of said boot, at a position to expand for an entering or exiting foot and configure to in line with a wearer's ankle, said first opening further defined as having parallel borders so as to define a closed position;

forming a second opening within said interior lining, said second opening formed within said inwardly facing side of the boot and aligned with said first opening to together define an opening section; and embedding a material with elastic properties between said first opening and said second opening and said material is entirely sandwiched between said outer shell and said interior lining at said first and second openings, said material stretching as said openings open so as to accommodate a foot's entry or exit, and automatically self-reverting to said closed position as said openings close, said closed position further defined as having said parallel borders directly touching one another which causes said unstretched material to be entirely hidden behind said first opening and said parallel borders when viewing directly from a medial side;

wherein said inwardly facing surface is said medial side, said first and said second openings are each located fully along said medial side and not directly intersecting said generally circular upper edge of said top opening of said boot, and each of said openings is ordinarily in said closed position, said first and second openings concurrently expanding to accommodate said foot's entry or exit from said boot, and each automatically self-reverting to its respective closed position when not accommodating said foot's entry or exit.

10. The method of claim 9, wherein said opening section is in an area of the boot to configure to cover the wearer's inside ankle bone.

11. The method of claim 9, wherein each of said openings is a slit.

12. The method of claim 9, wherein each of said openings is linear.

13. The method of claim 9, wherein each of said openings is surrounded by stitching.

14. The method of claim 9, wherein said opening section is a first slits and a second slit.

15. The method of claim 9, wherein said opening section is curved.

16. The method of claim 9, wherein said first opening and said second opening are aligned with one another.

17. The method of claim 9, wherein each of said openings is 3-4 inches in length.

* * * * *